US007346456B2

(12) United States Patent
Le Bemadjiel

(10) Patent No.: US 7,346,456 B2
(45) Date of Patent: Mar. 18, 2008

(54) WELLBORE DIAGNOSTIC SYSTEM AND METHOD

(75) Inventor: Djerassem Le Bemadjiel, Ndjamena (TD)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/459,075

(22) Filed: Jul. 21, 2006

(65) Prior Publication Data

US 2007/0185655 A1 Aug. 9, 2007

Related U.S. Application Data

(60) Provisional application No. 60/765,864, filed on Feb. 7, 2006.

(51) Int. Cl.
*G01V 1/40* (2006.01)
*G01V 9/02* (2006.01)

(52) U.S. Cl. ..... 702/9

(58) Field of Classification Search ..... 702/9
See application file for complete search history.

(56) References Cited

U.S. PATENT DOCUMENTS

| | | | |
|---|---|---|---|
| 6,101,447 | A | 8/2000 | Poe, Jr. |
| 6,820,702 | B2 * | 11/2004 | Niedermayr et al. ..... 175/57 |
| 2002/0059048 | A1 | 5/2002 | Hardy et al. |
| 2005/0270903 | A1 | 12/2005 | Ramakrishnan et al. |
| 2005/0279495 | A1 | 12/2005 | Chen et al. |
| 2006/0015310 | A1 | 1/2006 | Husen et al. |
| 2006/0016595 | A1 | 1/2006 | Rioufol et al. |
| 2006/0102342 | A1 | 5/2006 | East et al. |

* cited by examiner

*Primary Examiner*—John Barlow
*Assistant Examiner*—Cindy D. Khuu
(74) *Attorney, Agent, or Firm*—Trop, Pruner & Hu, P.C.; Bryan P. Galloway

(57) ABSTRACT

To perform diagnosis of a completion system, at least one parameter of the completion system in a wellbore is monitored using a sensor. A profile is generated based on the monitored parameter, and a real-time diagnosis is performed of an operation of the completion system based on a comparison of the generated profile and an expected profile to identify an anomaly.

16 Claims, 7 Drawing Sheets

WELLBORE DIAGNOSTIC SYSTEM AND METHOD

TECHNICAL FIELD

This invention relates generally to a system and method for diagnosing a wellbore to identify potential problems.

BACKGROUND

Well completion is performed in a wellbore to prepare the wellbore for production of hydrocarbons (from reservoirs adjacent the wellbore) or to prepare the wellbore for injection of fluids into surrounding formation. Examples of completion operations performed in a wellbore include perforating operations (in which perforating guns are lowered to a selected depth and fired to form perforations in any surrounding casing or liner and to extend perforations into surrounding formation), sand control operations (e.g., gravel packing, insertion of sand screens, and so forth), and other operations.

Various problems may occur with completion equipment installed in a wellbore to perform completion operations. The problems may result from service tool failures, bridging problems, and other causes. Bridging may occur during gravel packing, which is performed to provide sand control. Reducing sand production can be accomplished by placement of relatively large grain sand (gravel) around the exterior of a slotted, perforated, or other type pipe or sand screen. The gravel serves as a filter to reduce migration of sand with produced hydrocarbons. In a typical gravel pack completion, a sand screen is placed in the wellbore at the selected interval. Gravel is mixed with carrier fluid and pumped in slurry down a tubing and into an annulus between the sand screen and the wall of the wellbore. The carrier fluid in the slurry leaks off into the formation and/or through the sand screen. As a result, the gravel is deposited in the annulus around the sand screen where the gravel forms a gravel pack. Non-uniform gravel packing of the annulus can occur as a result of premature loss of carrier fluid from the slurry. The fluid can be lost in high permeability zones within the formation, leading to the creation of gravel bridges in the annulus before all the gravel has been placed. The gravel bridges can further restrict the flow of slurry through the annulus, which can result in voids within the gravel pack. Once production starts in the well, the flow of produced fluids will tend to be concentrated through any voids in the gravel pack, which can result in the migration of sand into the produced fluids. Also, over time, the gravel may settle and fill any void areas, which may loosen the gravel pack that is located higher up in the wellbore, potentially creating new voids.

Bridging problems and other types of problems that may occur in the wellbore are usually identified after a job (such as a gravel packing job) has been completed (post-job analysis). Even worse, a well operator may often not be aware that a problem exists until the well operator has actually started production. Once the well operator determines that a problem exists, the well may have to be shut down so that intervention can be performed to address or fix the problem(s). Intervention jobs, especially those performed at remote locations, can be expensive and can take a relatively long period of time. Also, any down time of a well can be costly.

SUMMARY

In general, methods and apparatus are provided to perform diagnostics of a wellbore to enable identification of issues in the wellbore during a job in the wellbore to enable early identification of issues.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
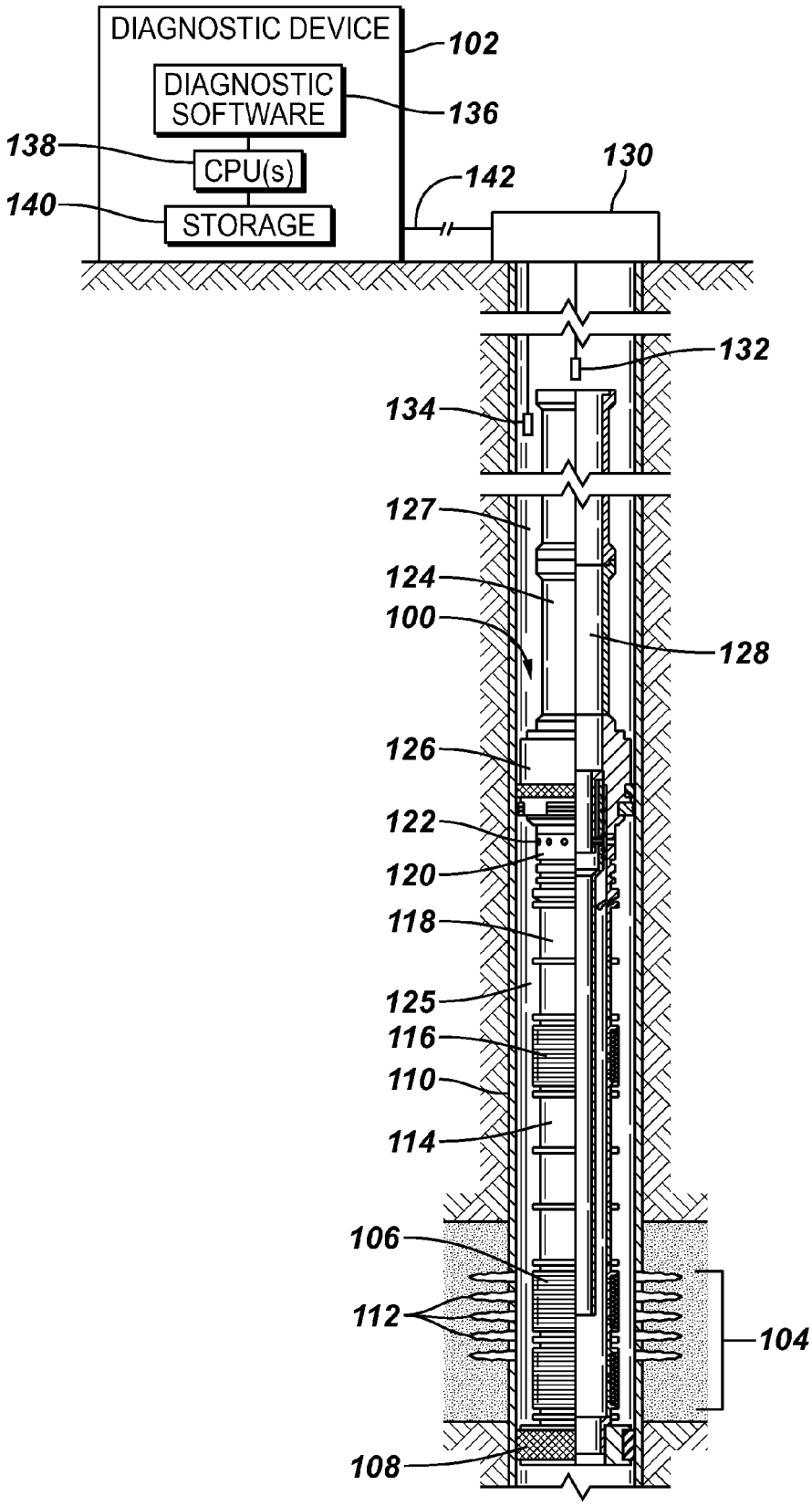
FIG. 1 illustrates an example system having a tool string and a diagnostic device, in accordance with an embodiment.

FIG. 1 depicts a system that includes a tool string positioned within the wellbore 100 and a diagnostic device 102 according to some embodiments for identifying anomalies associated with the operation of the tool string in the wellbore 100. The tool string depicted in the example of FIG. 1 is a sand control completion string to apply treatments for formation sand control. The treatment applied by the sand control completion string can be a gravel pack treatment in which a gravel slurry is pumped into the wellbore to a target well interval 104 to fill an annulus region of the wellbore interval 104. In the wellbore interval 104, the completion string has a lower screen 106, which is attached to a lower packer 108 below the lower screen 106. The packer 108 depicted in FIG. 1 is set such that the packer 108 is sealingly engaged against the inner wall of a casing 110 that lines the wellbore 100. As depicted in FIG. 1, perforations 112 are formed through the casing 110 in the wellbore interval 104 to extend tunnels into the surrounding formation.

A pipe section 114 extends above the lower screen 106, with the upper end of the pipe section 114 connected to an upper screen 114, where the upper screen 116 is a tell-tale screen. The upper tell-tale screen 116 is used to allow more complete coverage of the lower screen 106. In alternative embodiments, the upper screen 116 can be omitted.

A further pipe section 118 extends above the upper screen 116 to a cross-over port assembly 120, which has cross-over ports 122. An upper packer 126 is provided above the cross-over port assembly 120 in the depicted embodiment.

Both the upper packer 126 and the lower packer 108 are depicted as being in the set position. The cross-over ports 122 enable communication of fluid between the inner bore 128 of a tubing 124 and an annular region 125 below the upper packer 126 of the completion string.

To perform gravel pack treatment, a gravel slurry is pumped down the inner bore 128 of the tubing string 124, which gravel slurry exits through the cross-over ports 122 of the cross-over port assembly 120 into the annulus region 125.

Wellhead equipment 130 is provided at the earth surface from which the wellbore 100 extends. The wellhead equipment 130 is associated with sensors, including a tubing sensor 132 to measure pressure inside the tubing 124, and an annulus sensor 134 to measure pressure in an annulus region 127 above the upper packer 126.

Measurements from the sensors 132 and 134 are provided to the diagnostic device 102, which contains diagnostic software 136 executable on one or more central processing units (CPUs) 138 of the diagnostic device 102. The CPU(s) 138 is (are) connected to storage 140 (e.g., hard disk drive, volatile memory, etc.). In one example, the diagnostic device 102 can be a computer, which can be located at the well site or at a remote location away from the well site. Communication between the diagnostic device 102 and the wellhead 130 is accomplished over a link 142, which can be a wired link (an electrically wired or optically wired link), a wireless link, or other type of link.

The diagnostic device 102 is used for diagnosing various issues that may be associated with the completion string in the wellbore 100. One possible issue is a bridging problem that may occur during gravel packing, where sand starts drying above an unpacked zone such that a bridge is formed. Normally, when gravel properly packs a region outside the main screen (lower screen 106 in FIG. 1), such an event is detected as a screen-out event. However, using conventional detection techniques, it is difficult to differentiate a normal screen-out from a screen-out detected due to presence of a bridge.

Another issue that can occur is failure of a tool component, such as a valve in the cross-over port assembly 120 used for controlling communication through the cross-over ports 122. An example valve uses a ball seat that is shifted by a service tool (or alternatively, by hydraulic pressure, in response to electrical activation, and so forth) to control flow through the cross-over ports 122. However, in some cases, the ball seat may be only partially shifted, which may cause erosion of the ball seat and the cross-over ports 122 if such partial shifting is not detected early enough.

Although a sand control completion string is depicted in FIG. 1, it is noted that other types of strings can be used in other implementations. The diagnostic device 102 can be similarly used with such other types of strings to detect issues associated with such strings.

In accordance with some embodiments, to identify anomalies during the sand control completion operation (or other type of well operation), a comparison of a pressure response during the sand control completion operation (in which proppant is pumped into the wellbore in a slurry) to a known response of the well system using just clean fluid (without proppant) is performed. The known pressure response of the well system with clean fluid takes into account normal friction detected during an initial test (referred to as a step-rate test or SRT) where the normal friction includes tubular friction (associated with fluid flow in the inner bore 128 of the tubing 124), cross-over port friction (associated with fluid flow through the cross-over ports 122), and annular friction below the cross-over port assembly 120 (associated with fluid flow in the annulus region 125).

During an actual gravel pack operation, when gravel starts settling around the lower screen 106, an excess pressure drop occurs due to the fact that fluid is being forced through tortuous channels, which increases pressure drop across the proppant pack. The pressure response changes from the beginning of the job to the end of the job (when screen-out occurs). This excess pressure drop is added to the normal friction identified during the step-rate test. The friction generated because of settling gravel is relative to the area covered in the annulus region 125. By identifying the normal friction during the step-rate test prior to a particular job, the diagnostic software 136 in the diagnostic device 102 can identify excess frictions during the job, where the excess friction may be caused by anomalies or abnormal events (such as a broken bridge, cross-over port failure, and so forth).

Figure 2:
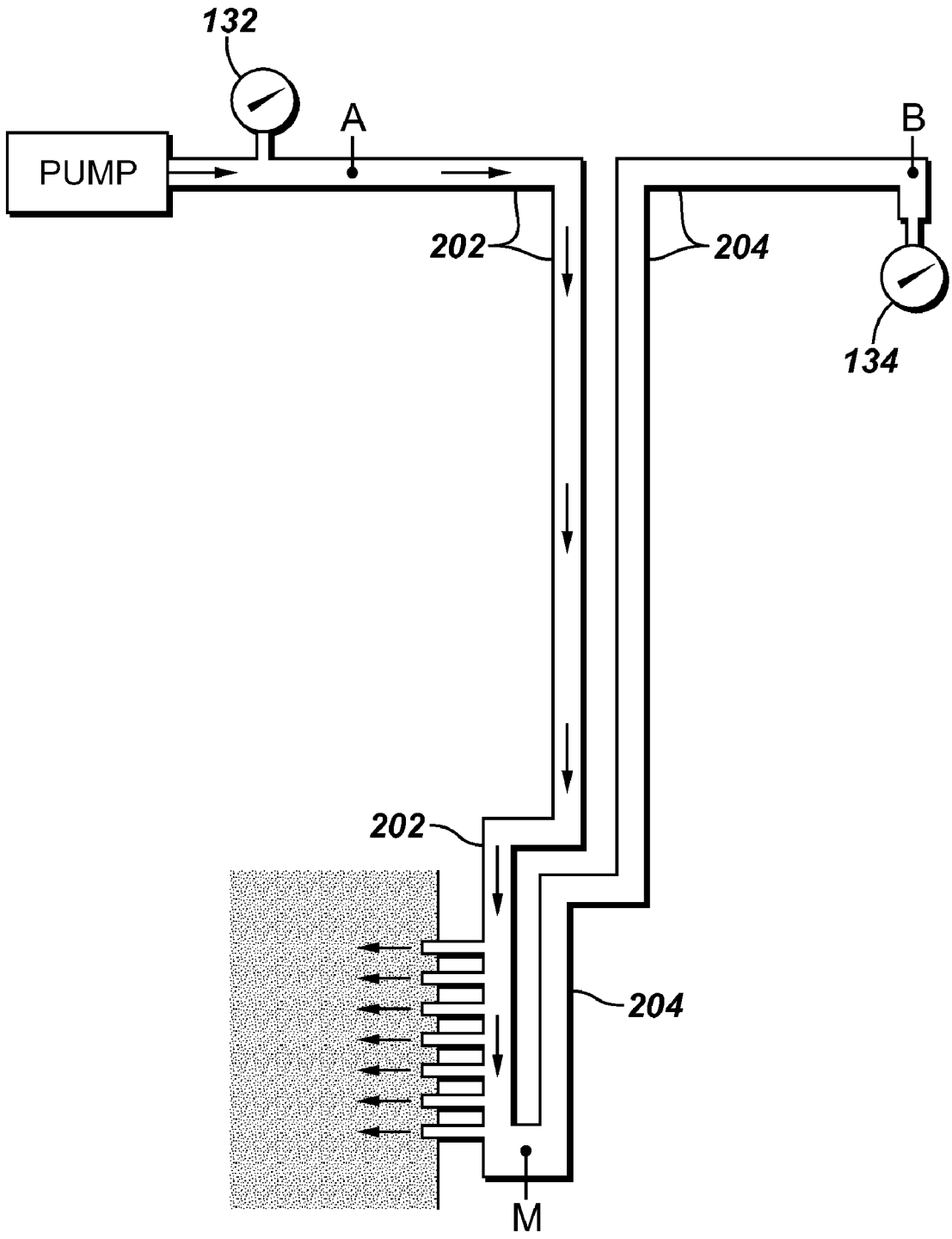
FIG. 2 is a schematic representation of the system of FIG. 1.

FIG. 2 is a representation of the wellbore as a hydraulic pipe system that includes a first pipe path 202 that includes the tubing 124 (above the upper packer 126), the cross-over ports 122, and the annulus 125 below the upper packer 126 (FIG. 1). A second pipe path 204 represents the backside of the hydraulic pipe system, where the second pipe path 204 includes the pipe sections 114, 118 (below the upper packer 126) and the annulus 127 above the upper packer 126. Point "A" represents the wellhead, and point "M" represents the transition between the annulus region 125 outside the main screen 106 and the inside of the pipe 114 connected to the main screen 106. Sensors 132 and 134 are shown connected to the first and second pipe paths 202, 204, respectively, for measuring respective pressures in the two paths.

In the hydraulic pipe system of FIG. 2, Bernoulli's equation can be applied:

$$P_A+\rho g Z_A+\tfrac{1}{2}\rho V^2=\text{constant} \qquad \text{(Eq. 1)}$$

where $P_A$ is the applied pressure at point A, $\rho G Z_A$ is the hydrostatic pressure at point A, and $\tfrac{1}{2}\rho V^2$ is the kinetic pressure.

Eq. 1 stipulates that in a given hydraulic pipe system, the sum of the sources of pressure in the given pipe system is a constant from one point to another including the pressure used to overcome friction along the flow path. If the principle is applied between point A and point M, the following is derived:

$$P_A+\rho g Z_A+\frac{1}{2}\rho V_A^2=P_M+\rho g Z_M+\frac{1}{2}\rho V_M^2+\sum_i \lambda_i \frac{L_i}{D_i}\frac{1}{2}V_i^2+\sum_j K_j\frac{1}{2}\rho V_j^2, \qquad \text{(Eq. 2)}$$

where $\sum_i \lambda_i \frac{L_i}{D_i}\frac{1}{2}V^2$ = friction along the pipes, and $\sum_j K_j\frac{1}{2}\rho V_j^2$ = localized friction.

At point M, the kinetic pressure is equal to zero because the fluid velocity at this point is equal to zero. $K_j$ represents a geometric factor that depends on the shape of the flow path or restriction, and $\lambda_i$ is the friction coefficient and is a function of Rhenolds number RE. During a step-rate test, with a given fluid (density ρ and viscosity μ), the total friction pressure between point A (wellhead) and point M is given by the following:

$$\text{Total Friction} = \sum_i \lambda_i \frac{L_i}{D_i}\frac{1}{2}V_i^2 + \sum_j K_j \frac{1}{2}\rho V_j^2. \quad \text{(Eq. 3)}$$

During the step-rate test, this total friction is related only to the clean fluid and is due to the friction of the pipe system including restrictions. When the main job starts, the initial well system is changed because of the inclusion of proppant pumped with fluid. This creates an external friction pressure δp added to the total friction above. Thus, δp represents any abnormal friction generated in the system by any event (screen out, cross-over port failure, fluid changing rheology inside the tubing, proppant friction pressure, etc.). During a job, the total friction measured is then:

$$\text{friction} = \sum_i \lambda_i \frac{L_i}{D_i}\frac{1}{2}V_i^2 + \sum_j K_j \frac{1}{2}\rho V_j^2 + \delta p. \quad \text{(Eq. 4)}$$

To quantify δp, a difference between total job friction and the total friction measured during the step-rate test is derived. This provides a D-Line formula (explained further below):

$$D\text{-Line} = \left(\sum_i \lambda_i \frac{L_i}{D_i}\frac{1}{2}V_i^2 + \sum_j k_j \frac{1}{2}\rho V_j^2 + \delta p\right) - \left(\sum_i \lambda_i \frac{L_i}{D_i}\frac{1}{2}V_i^2 + \sum_j k_j \frac{1}{2}\rho V_j^2\right)\left(1 - \frac{Cv}{Cv_{\max}}\right) \quad \text{(Eq. 5)}$$

where a proppant friction multiplier, ƒp, used in Eq. 7 below, is equal $$\left(1 - \frac{Cv}{Cv_{\max}}\right)^{-\varepsilon},$$

Cv is a solid volume factor, $Cv_{max}$ is a maximum solid volume factor, and ϵ is a proppant friction exponent (used to correct the effect of proppant friction in the slurry).

A Job Measured Friction represented in Eq. 8 (below) is thus $$\left(\sum_i \lambda_i \frac{L_i}{D_i}\frac{1}{2}V_i^2 + \sum_j k_j \frac{1}{2}\rho V_j^2 + \delta p\right)_{job},$$

and a Normal Friction in Eq. 7 (below) is thus $$\left(\sum_i \lambda_i \frac{L_i}{D_i}\frac{1}{2}V_i^2 + \sum_j k_j \frac{1}{2}\rho V_j^2\right)\left(1 \frac{C_v}{Cv_{\max}}\right)_{SRT}^{-\varepsilon}.$$

In accordance with some embodiments, the diagnostic software 136 produces a value for a special parameter referred to as a D-Line parameter, where the D-Line parameter is defined as follows:

$$D\text{-Line} = \text{Job Measured Friction} - \text{Normal Friction}, \quad \text{(Eq. 6)}$$

where the Job Measured Friction is the friction measured during the sand completion job, and the Normal Friction refers to the friction measured during the step-rate test. Normal Friction is expressed as follows:

$$\text{Normal Friction} = Fn(Q)_{SRT} * fp, \quad \text{(Eq. 7)}$$

where $Fn(Q)_{SRT}$ represents the friction profile determined during the step-rate test, and ƒp represents a free proppant friction multiplier that is set to a value to represent the amount of reduction of liquid in gravel slurry when gravel is added. $Fn(Q)_{SRT}$ is a function that depends upon the flow rate Q, such that the normal friction can be derived for any particular flow rate (Q) of the treatment fluid during an actual gravel pack job.

Job Measured Friction is represented as follows:

$$\text{Job Measured Friction} = Tr_\text{Press} + Hyd_t - (An_\text{Press} + Hyd_{An}), \quad \text{(Eq. 8)}$$

where Tr_Press is the treating pressure (the pressure of the treating fluid as measured by sensor 132), $Hyd_t$ represents the hydrostatic pressure in the tubing string 124, An_Press represents the measured annulus pressure, and $Hyd_{An}$ represents the hydrostatic pressure in the annulus region 125 below the upper packer 126. The measured annulus pressure, An_Press, is equal to the bottomhole pressure minus the hydrostatic pressure in the annulus 125 below the upper packer 126. The bottomhole pressure is communicated through the string of FIG. 1 to the upper annulus 127, so that the sensor 134 at the wellhead is able to measure the bottomhole pressure. The hydrostatic pressure ($Hyd_{An}$) in the annulus 125 is known based on the density and other fluid parameters. Similarly, the hydrostatic pressure ($Hyd_t$) in the tubing 114 is also known from the density of the fluid and the concentration of the proppant in the fluid.

Thus, effectively, the D-Line parameter is defined as follows:

$$D\text{-Line} = Tr_\text{Press} + Hyd_t - (An_\text{Press} + Hyd_{An}) - Fn(Q) * fp. \quad \text{(Eq.9)}$$

The detailed equation for the D-Line parameter is expressed in Eq. 5 (above). In accordance with some embodiments, the D-Line parameter is expressed as a pressure (other units of measurement can be used in other embodiments). Use of the D-Line parameter allows for real-time diagnostic of downhole events without use of any downhole sensors in some embodiments. "Real-time diagnosis" refers to diagnosis performed during a particular job, rather than diagnosis performed after a job has been completed. The D-Line parameter can be monitored to identify any abnormal restriction in the flow path from the wellhead to the downhole wellbore interval 104. The D-Line parameter can help identify a screen-out, a broken bridge, and a cross-over port failure, as examples. The D-Line parameter can also distinguish an anomaly (e.g., breakdown) occurring in the formation or perforation from an anomaly occurring in the completion string. The D-Line parameter can also help to decide whether to induce screen-out when the amount of proppant injected is above the designed amount. The D-Line parameter can be used to identify other issues as well.

Figure 3:
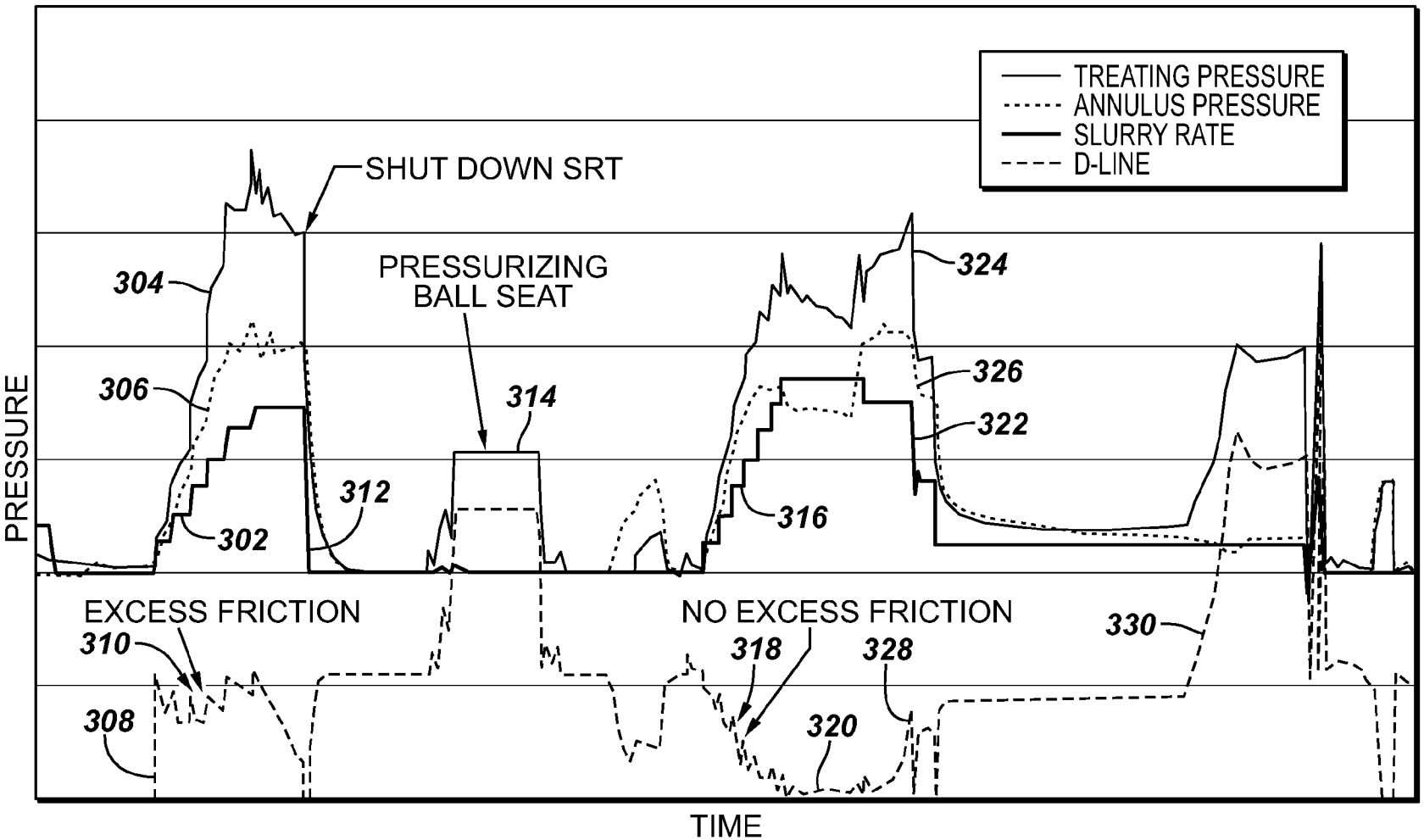
FIGS. 3-6 are graphs of outputs generated by the diagnostic device of FIG. 1, in accordance with an embodiment.

FIG. 3 is a graph that shows a real-time analysis performed using the diagnostic device 102 according to some embodiments. The graph is produced by the diagnostic software 136, which graph can be presented in a user interface (such as in a graphical user interface (GUI) of a display).

FIG. 3 is a graph that shows a real-time analysis performed using the diagnostic device 102 according to some embodiments. The graph is produced by the diagnostic software 136, which graph can be presented in a user interface (such as in a graphical user interface (GUI) of a display).

To perform a step-rate test, clean fluid (without gravel) is pumped down the tubing 124. The rate of the clean fluid is increased in a step-wise manner (as depicted at 302), which causes the tubing pressure (Tr_Press) to increase (at 304) and the annulus pressure (An_Press) to also increase (at 306). The D-Line parameter increases (at 308) according to the increasing tubing string and annulus pressures.

The D-Line parameter can be monitored to determine whether an anomaly has occurred downhole. Generally, the D-Line parameter provides a profile (over time) that is produced according to measurements provided by sensors 132, 134. One such anomaly is a problem in the cross-over port assembly 120 (such as a valve actuating member, e.g., a ball seat, of the cross-over port assembly not being shifted fully). Such an anomaly may cause excess friction to be present, which is reflected in the value of the D-Line parameter (at 310).

The excess friction can be represented as δp, which is defined as:

$$\delta p = \Sigma K \frac{1}{2} \rho V^2, \qquad \text{(Eq. 10)}$$

where K is a geometric factor, V is the fluid velocity across a restriction (in this case, the cross-over ports), and ρ is the fluid density. When the flow path is restricted, such as due to a partially shifted actuating member for the circulating ports, excess friction is generated that is described by the D-Line equation. The friction intrinsic to the well system in a normal condition will not change for a given clean fluid. However, if there is a flow restriction, such as due to the actuating member for the circulating ports riot being shifted fully, the D-Line parameter will show an excess friction (as represented by 310 in FIG. 3), where this excess friction is not intrinsic to the well system.

Upon detection of this excess friction, the well operator may shut down the step-rate test (at 312) by stopping the flow of the clean fluid. To ensure that the valve actuating member of the circulating port is shifted fully, an actuating pressure is applied (at 314) to cause full shifting of the actuating member to fix the problem detected using the monitored D-Line parameter.

After such actuation, a gravel pack slurry is pumped by increasing (at 316) the rate of the slurry flow also in a step-wise manner. Since the ball seat (or other actuating member) of the circulating port has now shifted fully, no excess friction is detected, as indicated by the reduction (at 318) of the D-Line parameter to a relatively constant value that is relatively flat over some amount of time (see 320 in FIG. 3).

If the upper tell-tale screen 116 (FIG. 1) was not present in the sand control completion string, then detecting a screen-out (where gravel is packed around the lower main screen 104 (FIG. 1)) is relatively easy. However, with the presence of the upper tell-tale screen 106, once the lower main screen 104 is completely covered, the fluid is not forced against the proppant pack but diverts through the upper tell-tale screen 106. This makes detecting screen-out more difficult.

However, using the D-Line parameter provided by the diagnostic software 136 according to some embodiments, detection of screen-out is more reliably accomplished. As depicted in FIG. 3, during a normal screen-out, the tubing and annulus pressures decrease (324, 326) when the treating fluid rate is decreased (at 322). However, the D-Line parameter continues to increase (at 328) even with the decreased treating fluid rate. The increase in the D-Line parameter indicates that screen-out has occurred. If screen-out had not occurred, then the D-Line parameter would have stayed relatively flat (consistent with the region 320).

At the point where the upper tell-tale screen 116 is covered, the D-Line parameter increases sharply (at 330). The sharp increase of the D-Line parameter is due to the fact that once the upper tell-tale screen 116 is covered, there is no further room for the fluid to go through so the friction pressure is significantly increased. At this point, the sand control completion job has completed successfully and the completion string can be shut down.

Figure 4:
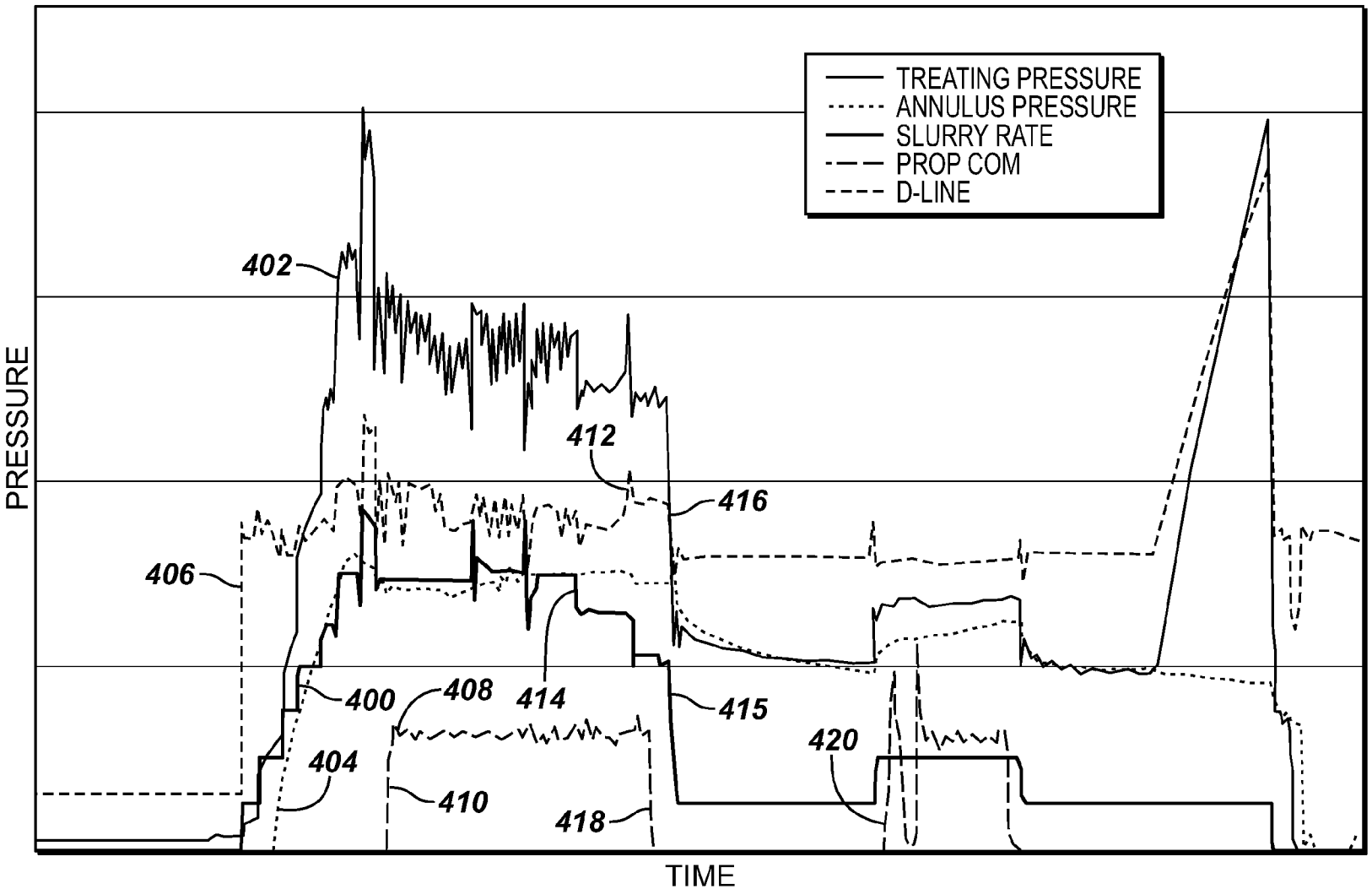

FIG. 4 shows detection of a bridge formed during a gravel pack operation. A bridge is considered to have formed if the total proppant below the cross-over port assembly 120 is less than the amount of proppant required to cover the annular space around the lower screen 104. As depicted in FIG. 4, the rate at which the treating fluid is pumped into the tubing 124 is increased in a step-wise manner (at 400), which causes the tubing pressure to increase (at 402) and the annulus pressure to increase (at 404). The D-Line parameter also increases in value (at 406).

A curve 408 represents the concentration of proppant in the treating fluid (in this case, the proppant is the gravel). Proppant is added to the treating fluid (as indicated at 410). At 414, the treating fluid rate begins to decrease, and the D-Line parameter increases (at 412), which would indicate a screen-out condition. However, because of formation of the bridge, this screen-out indicator is a false screen-out indicator. Note that the well operator has shut off the proppant (proppant concentration reduced to zero at 418) due to this false screen out condition.

Further dropping (at 415) of the rate of treating fluid usually causes the bridge to break down and fall. When the bridge breaks down and falls, the D-Line parameter also drops in value (at 416) (rather than increase in value) as would normally be the case even with decreasing treating fluid rate. The drop in the D-Line parameter at 416 is an indication that a false screen-out has occurred. When the well operator notices the drop in the D-Line parameter that indicates the collapse of the bridge, the well operator can perform a "top off" on the fly by again increasing (at 420) the proppant concentration to achieve a real screen-out condition.

Figure 5:
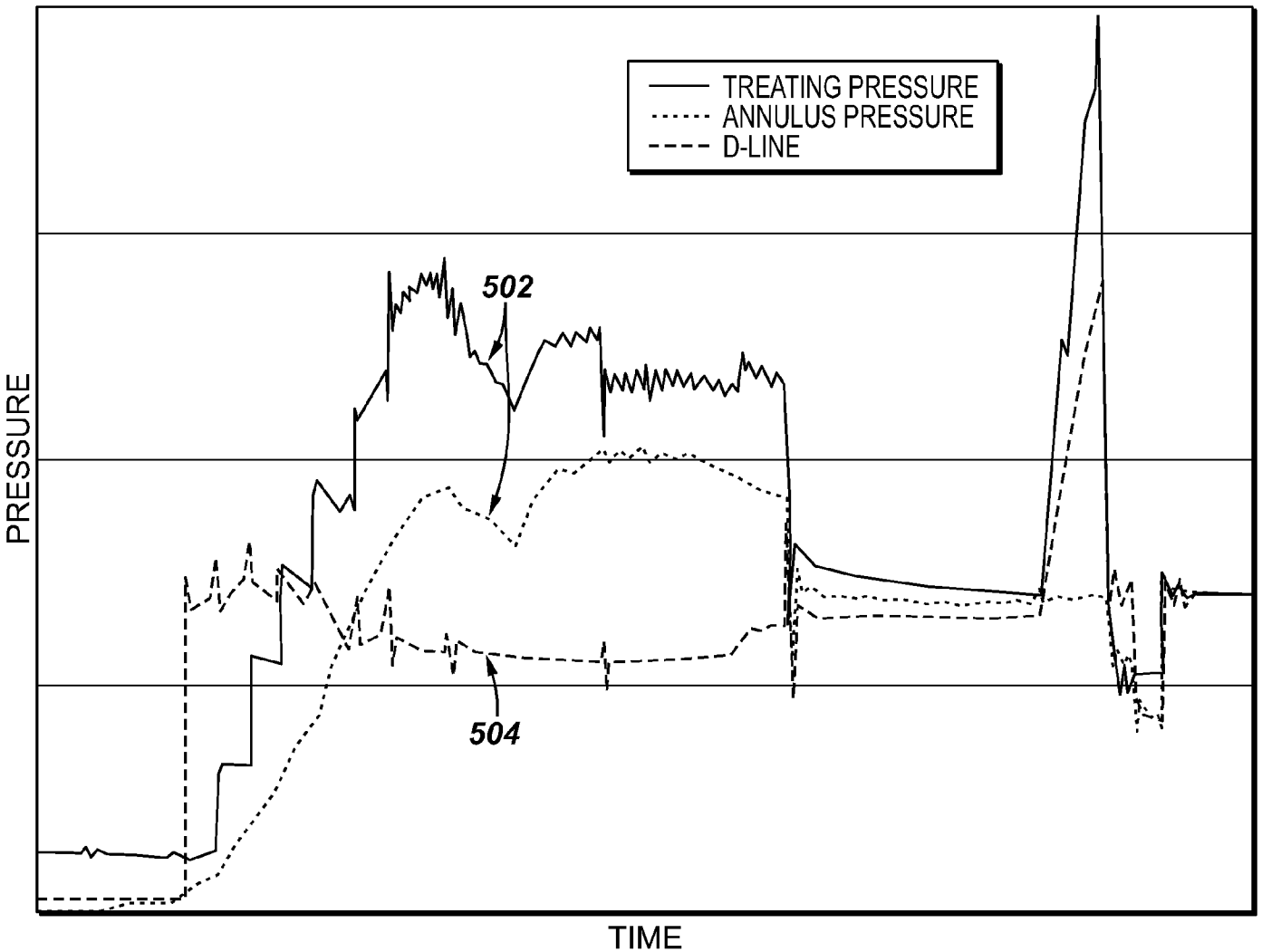

As noted above, the D-Line detection technique can be used to distinguish between anomalies in the completion string and anomalies in the formation or perforations. Any breakdown or other problem in the formation and/or perforations will be reflected in the treating (tubing) pressure and annulus pressure (see 502 in FIG. 5), but will not be reflected in the D-Line parameter (see 504 in FIG. 5). Therefore, any unexpected behavior in the treating pressure/annulus pressure that is not reflected in the D-Line parameter is indicative of a problem occurring in the formation and/or perforations (e.g., perforating tunnels collapsing, etc.).

Figure 6:
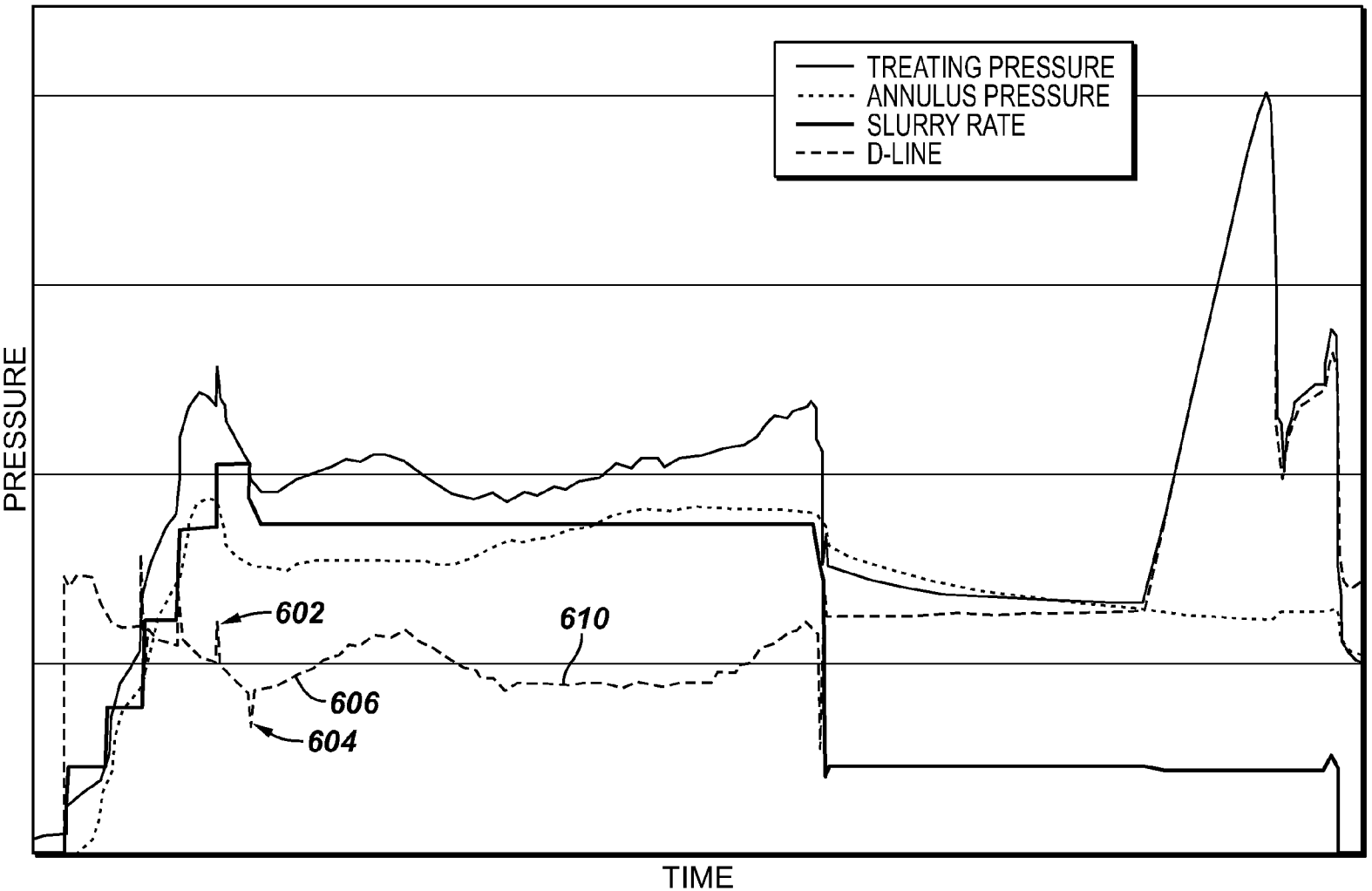

The D-Line parameter can also be used to perform fluid quality check in the completion string. If the fluid pumped changes (such as due to surface equipment failure) or if the fluid in the string changes for any other reason, the D-Line parameter will change to reflect the change in the fluid. As seen in FIG. 6, at the beginning of a job, the casing is full of high friction fluid. At some point, gel (slick water) is pumped into the tubing to displace the high friction fluid (indicated at 602 on the D-Line curve in FIG. 6), where the slick water has a lower friction. This is indicated at 604 in FIG. 6. However, if the surface equipment stops pumping the gel (such as at point 604), the D-Line parameter increases (606 in FIG. 6). This increase in the D-Line parameter is noticed by the well operator so that the well operator can check the gel pumping equipment. Once gel starts pumping again, the D-Line parameter decreases in value until the tubing is filled with slick water, at which point the D-Line parameter flattens out (at 610).

Figure 7:
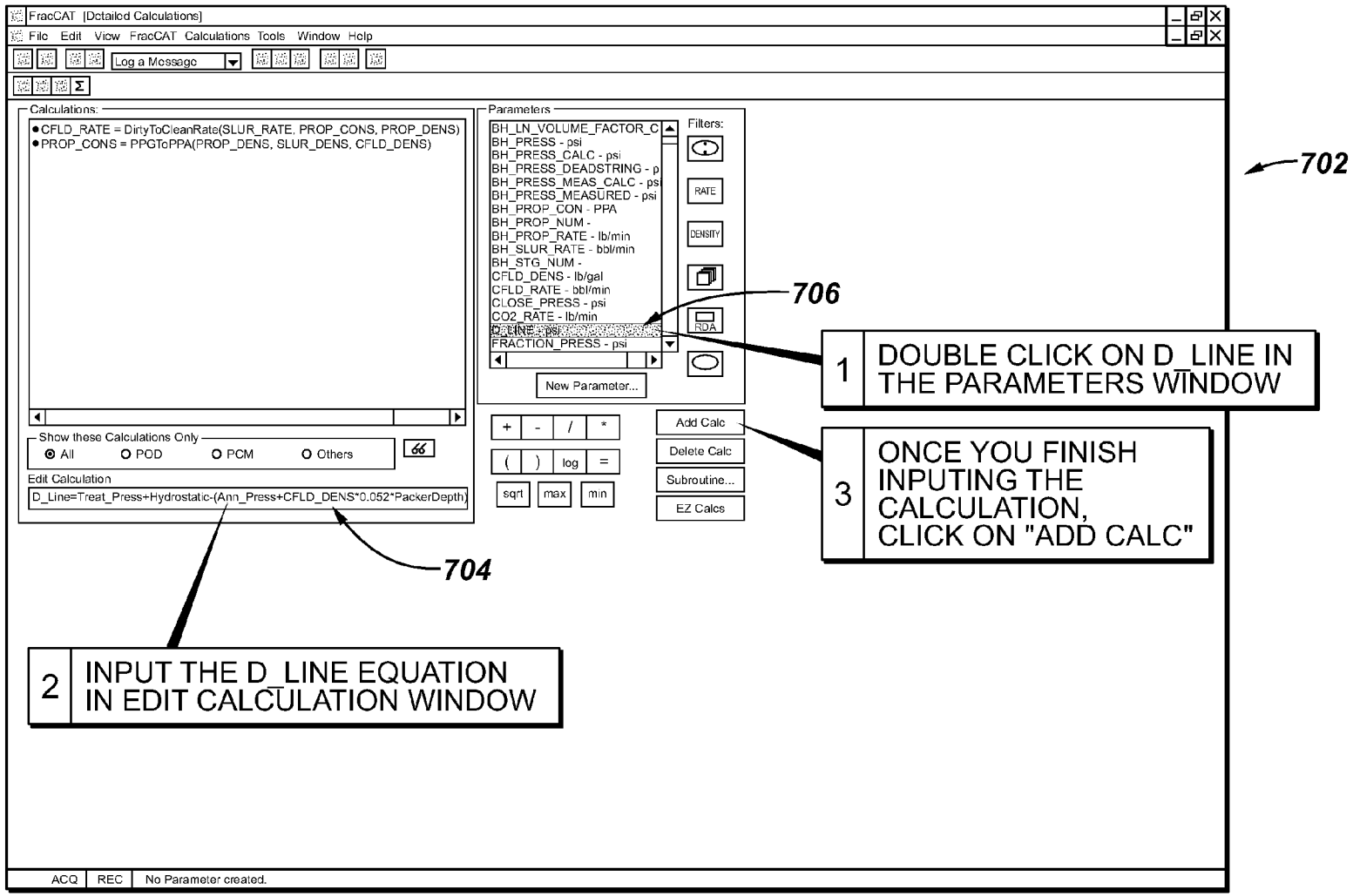
FIG. 7 illustrates an example graphical user interface (GUI) screen, according to an embodiment.

FIG. 7 shows an example GUI screen 702 that is presentable to a user at the diagnostic device 102 (FIG. 1). The GUI screen 702 has an input entry 704 in which the user can enter the equation for the D-Line parameter. A user can select on the D-Line entry (at 706) from a list of parameters to enable the use of the D-Line feature. Once the equation for D-Line has been entered in the input entry 704, a button "Add Calc" can be activated to perform the D-Line calculations discussed above.

A diagnostic system and technique has been described that provides a predefined parameter that is responsive to downhole frictional conditions to enable real-time detection of anomalies. As a result, certain anomalies can be detected early so that any problems can be fixed prior to completion of a job, such as a gravel packing job.

Instructions of software described above (including the diagnostic software 136 in FIG. 1) are loaded for execution on a processor (e.g., CPU(s) 138). The processor includes microprocessors, microcontrollers, processor modules or subsystems (including one or more microprocessors or microcontrollers), or other control or computing devices.

Data and instructions (of the software) are stored in respective storage devices (e.g., 140), which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

While the invention has been disclosed with respect to a limited number of embodiments, those skilled in the art will appreciate numerous modifications and variations there from. It is intended that the appended claims cover such modifications and variations as fall within the true spirit and scope of the invention.

What is claimed is:

1. A method comprising:

monitoring at least one parameter of a completion system in a wellbore using at least one sensor;

generating a profile based on the monitored at least one parameter;

performing real-time diagnosis of an operation of the completion system based on a comparison of the generated profile and an expected profile to identify an anomaly; and creating the expected profile based on a test using a first type fluid, wherein performing the real-time diagnosis of the operation in the wellbore comprises performing real-time diagnosis of the operation in which a treatment is applied, the treatment containing a material not contained in the first-type fluid.

2. The method of claim 1, wherein generating the profile comprises generating a pressure profile.

3. The method of claim 1, wherein performing the real-time diagnosis comprises performing real-time diagnosis of the operation in which the material comprises a proppant.

4. The method of claim 1, wherein performing the real-time diagnosis comprises identifying a bridge problem during a gravel pack operation.

5. The method of claim 1, wherein performing the real-rime diagnosis comprises identifying excess friction indicative of a fluid flow restriction.

6. The method of claim 1, wherein performing the real-time diagnosis comprises identifying change in type of fluid in the completion system.

7. The method of claim 1, wherein performing the real-time diagnosis comprises identifying whether the anomaly is a problem that occurred in the completion system or a problem that occurred in a formation adjacent the wellbore.

8. The method of claim 1, wherein monitoring the at least one parameter comprises monitoring a tubing pressure and an annulus pressure with respective sensors.

9. A method comprising:

monitoring at least one parameter of a completion system in a wellbore using at least one sensor;

generating a profile based on the monitored at least one parameter; and performing real-time diagnosis of an operation of the completion system based on a comparison of the generated profile and an expected profile to identify an anomaly, wherein generating the profile comprises computing a value that is based on tubing pressure and annulus pressure, wherein computing the value comprises computing the value that is equal to $$\text{Tr_Press}+\text{Hyd}_t-(\text{An_press}+\text{Hyd}_{An})$$

where the expected profile is represented as Normal Friction, and wherein the comparison of the generated profile and the expected profile is expressed as $$\text{Tr_Press}+\text{Hyd}_t-(\text{An_Press}+\text{Hyd}_{An})-\text{Normal Friction},$$

where Tr_Press is a treating pressure associated with pressure applied with treating fluid in the operation, $\text{Hyd}_t$ is hydrostatic pressure in a tubing, An_Press is an annulus pressure, $\text{Hyd}_{An}$ is a hydrostatic pressure in an annulus, and Normal Friction represents a friction measured during an initial test.

10. A method comprising:

monitoring at least one parameter of a completion system in a wellbore using at least one sensor;

generating a profile based on the monitored at least one parameter; and performing real-time diagnosis of an operation of the completion system based on a comparison of the generated profile and an expected profile to identify an anomaly, wherein generating the profile comprises computing a value that is based on tubing pressure and annulus pressure, wherein the generated profile represents a friction during the operation, and the expected profile represents a friction during a prior test, and wherein the comparison of the generated profile and the expected profile is computed by taking a difference between the friction during the operation and the friction during the prior test.

11. An article comprising at least one computer-readable storage medium that contains instructions that when executed cause a system to:

during a wellbore job, monitor at least one parameter of a completion system in a wellbore using at least one sensor;

generate a profile based on the monitored at least one parameter; and perform real-time diagnosis of an operation of the completion system during the wellbore job based on a comparison of the generated profile and an expected profile to identify an anomaly, wherein the generated profile represents a friction of the completion system during the wellbore job, and the expected profile represents a friction of the completion system determined in a test.

12. The article of claim 11, wherein generating the profile comprises generating a pressure profile.

13. The article of claim 11, wherein the instructions when executed cause the system to further create the expected profile based on the test using a first type fluid.

14. The article of claim 13, wherein performing the real-time diagnosis of the operation in the wellbore comprises performing real-time diagnosis of the operation in which a treatment is applied, the treatment containing a material not contained in the first-type fluid.

15. The article of claim 11, wherein the friction of the completion system during the wellbore job is based on a treating pressure of treating fluid applied during the wellbore job, and on an annulus pressure of the completion system.

16. The article of claim 11, wherein the friction of the completion system during the wellbore job is equal to $$\text{Tr_Press}+\text{Hyd}_t-(\text{An_Press}+\text{Hyd}_{An}),$$

wherein the friction of the completion system determined in a test is Normal Friction, wherein comparison of the generated profile and the expected profile comprises computing $$\text{Tr_Press}+\text{Hyd}_t-(\text{An_Press}+\text{Hyd}_{An})-\text{Normal Friction},$$

where Tr_Press is a treating pressure associated with pressure applied with treating fluid during the wellbore job, $\text{Hyd}_t$ is hydrostatic pressure in a tubing, An_Press is an annulus pressure, and $\text{Hyd}_{An}$ is a hydrostatic pressure in an annulus.

* * * * *